US005207435A

United States Patent [19]

Tanner

[11] Patent Number: 5,207,435

[45] Date of Patent: May 4, 1993

[54] WORD GAME

[76] Inventor: Scott Tanner, 1621 Bennett St., Utica, N.Y. 13502

[21] Appl. No.: 874,407

[22] Filed: Apr. 27, 1992

[51] Int. Cl.[5] ..... A63F 9/18

[52] U.S. Cl. ..... 273/429; 273/153 R; 273/272; 273/292; 273/299; 434/347

[58] Field of Search ..... 273/429, 430, 431, 240, 273/272, 292, 299, 302, 153; 434/156, 322, 347

[56] References Cited

U.S. PATENT DOCUMENTS 4,558,865 12/1985 Isgar ..... 273/430 X
4,955,614 9/1990 Buda ..... 273/272 X
4,964,642 10/1990 Kamille ..... 273/240

FOREIGN PATENT DOCUMENTS 2189159 10/1987 United Kingdom ..... 273/254

*Primary Examiner*—V. Millin

*Assistant Examiner*—Raleigh W. Chiu

*Attorney, Agent, or Firm*—Katherine McGuire

[57] ABSTRACT

A game for play between two or more players/teams with a deck of clue cards each having a set of scrambled words imprinted thereon and an unsolved main word thereabove which is represented only by blank spaces and its first and possibly second letters to serve as a clue. The players/teams take turns drawing clue cards and attempting to unscramble the scrambled words and solve the main word with a set time period. The main word is a synonym or the name of a category of which the scrambled words are like synonyms or elements of the category, respectively. A second deck of cards having only one scrambled word thereon are provided to play bonus and challenge rounds. Points are awarded according to how many words are solved by each player/team and the first player/team to reach 100 pints wins the game.

10 Claims, 1 Drawing Sheet

WORD GAME

BACKGROUND OF THE INVENTION

This invention relates to word games and, more particularly, to a word game played between opposing teams which take turns trying to unscramble a series of scrambled words which are part of a category or synonym of a word which must also be solved.

Games which require use of the mental faculties are of increasing popularity with many being geared especially to the where the players are posed with a question from a chosen topical category which they must answer correctly to advance their playing piece on the game board.

Other adult-oriented games which relate more to "word" solving as opposed to "question" solving, as is the present game, are OUTBURST! ® sold by Hersch and Company and HUGGERMUGGER ® sold by The Huggermugger Company. In playing OUTBURST! ®, each team must shout out words which are elements of a category given to them by the opposing team. The opposing team holds a list of the correct words which are checked off as the playing team names them. All words on the list must be named within a prescribed time period to win points.

In playing HUGGERMUGGER ®, a "mysteryword" must be solved with one letter of the mysteryword being revealed to a player each time that player correctly answers a question given from one of four different categories which are: luck of the draw; spelling; definitions; or scrambled words. The first to solve the mysteryword wins the game.

In the scrambled word category, which is the only portion of HUGGERMUGGER ® similar to the present game, the player is given a series of six letters and must unscramble the letters to form an actual word. If the player's answer is a legitimate word other than an intended answer, he may receive credit for a correct answer.

SUMMARY OF THE INVENTION

It is a principle object of the present invention to provide a thought-provoking game which requires the players to successfully unscramble a list of words and then solve the word to which they allude.

It is a further object of the present invention to provide a game which includes randomly intermittent bonus rounds and challenge rounds which add further excitement and interest to the game.

It is another object of the present invention to provide a game which requires only game cards, a timer and paper and pen to play.

Other objects will in part be obvious and in part appear hereinafter.

In accordance with the foregoing objects, the invention comprises a game which is played between two or more players. Players divide themselves up into equal teams with a maximum of six teams playing. The materials needed to play the game are a set of clue, bonus and challenge cards; a timer; and a pen and paper. The clue cards each have a list of four scrambled clue words and a main word thereabove, the main word being shown only by blank spaces for each of its letters in addition to one or two of its first letters being revealed to serve as a clue.

Play begins by the teams each taking their respective turns at solving drawn clue cards in a prescribed period of time. The cards are solved by unscrambling the four scrambled clue words and then filling in the blanks to solve the main word which is either a synonym or a name of a category of which the four scrambled clue words are synonyms or elements thereof, respectively. The answers are listed on the reverse side of the clue card and points are awarded based on the total number of words solved on each card.

Should a playing team select a clue card with the word "bonus" on it, one player from that team is selected to play a bonus round wherein the player will solve as many bonus cards as he/she can within a prescribed time period. Each bonus card has one scrambled word on it with the solution on the back and points are awarded for each card solved.

In a like manner, when a playing team draws a clue card with the word "challenge" on it, play proceeds as in the bonus round except that one player from each team are pitted against each other. Scores are tallied and the player with the highest score receives the points for his/her team and play resumes with that team.

DETAILED DESCRIPTION

Figures 1, 2, 3, 4, 5, 6:
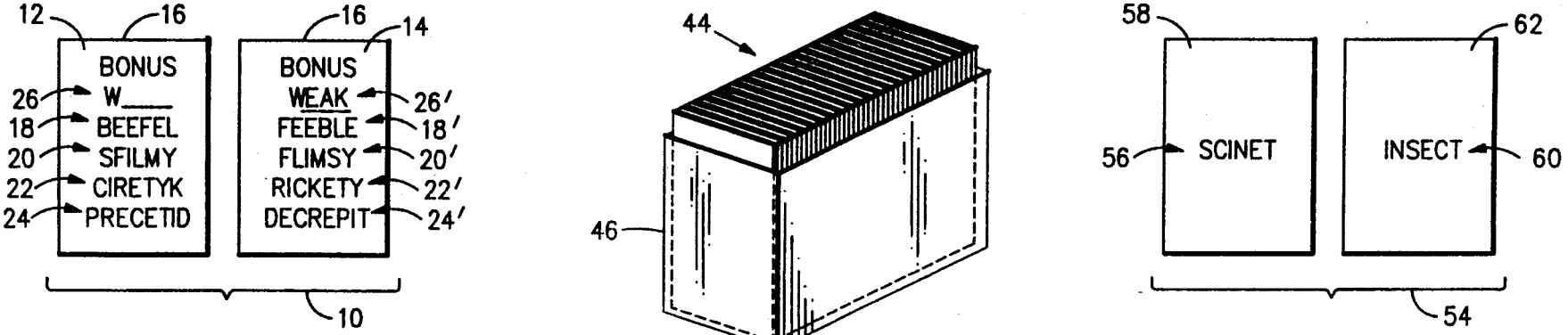
FIG. 1 is a composite, elevational view showing the front and back surfaces of a representative clue card with the word "BONUS" imprinted thereon.
FIG. 2 is a perspective view of a deck of clue cards deposited within a card holder with portions of the cards shown in dotted outline.
FIG. 3 is a composite, elevational view of the front and back sides of a representative bonus-challenge card.
FIG. 4 is a simplified representation of a timing mechanism.
FIG. 5 is a composite, perspective view of a pad of paper and a writing utensil.
FIG. 6 is a composite, elevational view showing the front and back surfaces of a representative clue card with the word "CHALLENGE" imprinted thereon.

Referring now to the drawings, there is seen in FIG. 1 a representative clue card designated generally by the numeral 10, the surface of which is considered the front of the card being labeled with reference numeral 12 and the opposite or back surface being labeled with reference numeral 14 Front surface 12 is seen to have four scrambled clue words 18, 20, 22 and 24 imprinted thereon with the letter "W" followed by three space marks where the other letters of a main word 26 would fit appearing above the scrambled clue words. The word "BONUS" also is imprinted along top edge 16 whose presence and purpose will be explained below during description of the "bonus round" portion of the game.

Back surface 14 of card 10 has the solutions 18', 20', 22', 24' and 26' of the scrambled clue words 18, 20, 22, 24 and main word 26, respectively, imprinted thereon. Briefly, play of the game involves players solving as many of the scrambled clue words 18, 20, 22 and 24 as possible and hopefully also solving main word 26 within a predetermined period of time to accumulate points. It will be readily noticed that the unscrambled clue words 18', 20', 22' and 24' are synonyms of main word 26' in FIG. 1. Alternatively, the unscrambled clue words may also be elements of a category with the main word being the name of the category as seen in FIG. 6.

In FIG. 6, scrambled clue words 28, 30, 32 and 34 appearing on front surface 36 of card 38 are names of states 28', 30', 32' and 34' and unsolved main word 40 is the category "STATE" 40' as seen on back surface 42. Thus, in both FIGS. 1 and 6, the clue words serve as clues to solving the main word which is only revealed as spaces including its first and possibly second letters on the front surface 12 of card 10. It will also be noticed in FIG. 6 that the word "CHALLENGE" appears above the main word 40, 40' whose presence and purpose will also be explained below during discussion of the "challenge round" portion of the game.

Discussion is now turned to the rules and manner of playing the game. Players divide into evenly numbered teams with a proposed maximum number of teams being six. The first team to begin play by solving a clue card will be considered the "playing team" and will be chosen by any random chance method. The team to the playing team's left draws a clue card from a deck of clue cards 44 placed in a card holder 46 which exposes only a small portion of the top ends of deck 44 to effectively hide the printed material on the clue cards within holder 46 until they are removed therefrom.

Each clue card has a different set of scrambled clue words and main words thereon with clue cards 10 and 38 seen in FIGS. 1 and 6, respectively, being only two examples thereof. A predetermined number of clue cards also have the words "BONUS" (FIG. 1) and "CHALLENGE" (FIG. 6) imprinted thereon.

Returning discussion now back to play of the game, the team to the playing team's left draws a clue card from the front of deck 44. Without letting the playing team see, the team on the left looks at the back surface of the card and the solutions thereon such as seen on back surface 14 in FIG. 1. The clue card is then passed to the playing team in a manner which permits them only to see the front surface 12 of the clue card having the scrambled words and unsolved main word. At this time, a timer which is set for a predetermined time period is started such as timer 48 seen in FIG. 4. The playing team proceeds to solve as many of the scrambled words as possible by shouting out what they believe to be the answer. The playing team may work out the solutions on a paper 50 with a writing utensil 52 (FIG. 5) which is also used to keep score. The playing team also attempts to solve the main word which is also shouted aloud, all of which must be accomplished within the prescribed time period. The team to the left indicates whether or not the playing team's solutions to the scrambled words and main word is correct every time a proposed answer is shouted aloud.

Points are tallied according to how many words were unscrambled and if the main word was solved as follows:

1 clue word = 0 points
2 clue words = 1 point
3 clue words = 2 points
4 clue words = 3 points
main word = 2 points, whereby the total possible points for each clue card is 5 (unscrambling all four clue words equals 3 points plus an additional 2 points for solving the main word). Play resumes in a clockwise direction with the previous playing team drawing the next clue card from deck 44 and handing it over to the team on their right (after they have seen the answers on the back surface) which becomes the new playing team.

When a playing team receives a clue card with the word "BONUS" on it, such as card 10 seen in FIG. 1, they must select one player from among their team to play a "bonus round". The bonus round is played using bonus-challenge cards, an example of one of such cards being seen in FIG. 3 at 54. Each bonus-challenge card has a scrambled word 56 on its front surface 58 and the solution 60 imprinted on its back surface 62. A deck of bonus-challenge cards with different words imprinted on each like card 54 are placed on a flat surface with the front surfaces having the scrambled words facing upward.

Timer 48 is set and the player selected from the playing team to play the bonus round as described above attempts to solve as many bonus-challenge cards as he/she can within the set time period, successively drawing and solving bonus-challenge cards from the bonus-challenge card deck. When the player feels he/she has solved the bonus-challenge card, he/she writes the solution on paper 50 with writing utensil 52. If the player finds a drawn bonus-challenge card too difficult to solve, he/she may set that card aside and draw another bonus-challenge card.

When the timer stops, the player's written answers are checked against the back of each respective card which shows the correct answer. His/her playing team is awarded one point for every correct answer and penalized one point for every card skipped or incorrect answer. Some of the scrambled words may actually form more than one word and points are awarded for legitimate words even though they are not the "correct" word which appears on the reverse side of the bonus-challenge card. "Legitimate" words must be found in the dictionary.

After the bonus player's score has been tallied and added into his/her team's score, normal play resumes with the same team by them now solving the clue card which had the "BONUS" word on it in the manner heretofore described.

When a playing team receives a clue card with the word "CHALLENGE" on it (FIG. 6), each team will select one player to play the "challenge round". During the challenge round, the same rules apply as for the bonus round described above except that instead of one player from one team playing, one player from each team plays by solving as many bonus-challenge cards (FIG. 3) as they can within the time period. At the end of the time period, each player's score is tallied and only the player with the highest score gets to keep his/her score and have it added to their team's running score. In the event of a tie for the highest score, no one receives their points and normal play returns to the team which received the challenge-clue card.

In both the challenge and bonus rounds, the player(s) selected to participate in the round cannot participate in another bonus or challenge round until all other players on the team have participated at least once in a bonus or challenge round.

Since it is not required that all clue words on a clue card be solved before the main word is solved, it is a wise tactic to work back and forth between solving the clue words and the main word. It is also suggested that playing teams divide the scrambled clue words among themselves for quicker solutions. The first team to reach 100 points wins the game.

What is claimed is:

1. A word-solving game played between two or more players/teams comprising:

a) a first deck of clue cards each having front and back surfaces, said front surface having at least one scrambled word and an unsolved main word imprinted thereon, said unsolved main word being represented by at least the first letter of said main word followed by a number of space marks, said number of space marks equaling the number of letters of said main word following said at least first letter, said back surface including the solutions to said at least one scrambled word and said main word imprinted thereon; and b) means selectively hiding substantially all of said front and back surfaces of said first deck of clue cards from the view of said players.

2. The invention according to claim 1 and further comprising a second deck of bonus-challenge cards each having front and back surfaces, said bonus-challenge card front surface having a scrambled word imprinted thereon and said bonus-challenge card back surface having the solution to said scrambled word imprinted on said bonus-challenge card front surface, and wherein a first predetermined number of said clue cards further include the word "BONUS" imprinted thereon and a second predetermined number of said clue cards further include the word "CHALLENGE" imprinted thereon.

3. The invention according to claim 2 wherein said game further comprises a timing mechanism operable to monitor each of said players/teams turn at play.

4. The invention according to claim 3 wherein said game further comprises a pad of paper and a writing utensil.

5. The invention according to claim 1 wherein said at least one scrambled word solution is a synonym of said main word.

6. The invention according to claim 1 wherein said at least one scrambled word solution is an element of a category and wherein said main word is said category.

7. The invention according to claim 1 wherein said clue card front surface includes four of said scrambled words and said clue card back surface includes the solutions to said four scrambled words.

8. A method of playing a word-solving game between two or more players/teams comprising the steps of:

a) determining which of said players/teams will play first in accordance with any random chance method;

b) providing said first playing player/team with a first clue card selected from a deck of clue cards, each of said clue cards each having front and back surfaces with said front surface having at least one scrambled word and an unsolved main word imprinted thereon, said unsolved main word being represented by at least the first letter of said main word followed by a number of space marks, said number of space marks equaling the number of letters of said main word following said at least first letter, said clue card back surface including the solutions to said at least one scrambled word and said main word imprinted thereon;

c) setting a timing mechanism for a predetermined amount of time;

d) said first playing player/team attempting to solve said at least one scrambled word and said main word within said predetermined amount of time without looking at said solutions on said clue card back surface;

e) awarding a predetermined number of points to said first playing player/team for each of said at least one scrambled words and said main word solved as compared with said solutions on said clue card back surface; and f) continuing play by each of said two or more players/teams consecutively performing steps 8b)-8e) until one of said two or more players/teams reaches a predetermined winning amount of said points.

9. The method of claim 8 wherein a first predetermined number of said clue cards further includes the word "BONUS" imprinted thereon, said method further comprising the step of:

a) said first playing player/team playing a bonus round each time said first playing player/team is provided with a said clue card having the word "BONUS" imprinted thereon, said bonus round comprising the additional steps of:

i) said first playing player/team selecting one player among themselves to play said bonus round;

ii) setting a time mechanism for a predetermined amount of time;

iii) said one player drawing a bonuschallenge card having front and back surfaces, said bonus-challenge card front surface having a scrambled word imprinted thereon with said bonus-challenge card back surface including the solution to said scrambled word on said bonus-challenge card front surface;

iv) said one player attempting to solve said scrambled word on said bonus-challenge card front surface without looking at said solution on said bonus-challenge card back surface;

v) said one player continuing to draw and solve as many of said bonus-challenge cards as possible within said predetermined amount of time;

vi) awarding said one player a predetermined number of points for each of said bonuschallenge cards solved as compared with said solution on said bonus-challenge card back surface in accordance with steps 9iii) and 9v); and vii) adding the total of said predetermined number of points to the score of said first playing player/team.

10. The method of claim 9 wherein a second predetermined number of clue cards further includes the word "CHALLENGE" imprinted thereon, said method further comprising the step of:

a) said first playing player/team playing a challenge round each time said first playing player/team is provided with a said clue card having the word "CHALLENGE" imprinted thereon, said challenge round comprising the additional steps of:

i) each of said two or more player/teams selecting one player among themselves to play said challenge round;

ii) setting a timing mechanism for a predetermined amount of time;

iii) each of said one players drawing a bonus-challenge card having front and back surfaces, said bonus-challenge card front surface having a scrambled word imprinted thereon with said bonus-challenge card back surface including the solution to said scrambled word on said bonus-challenge card front surface;

iv) each of said one players attempting to solve said scrambled word on said bonus-challenge card front surface without looking at said solution on said bonus-challenge card back surface;

v) each of said one players continuing to draw and solve as many of said bonus-challenge cards as possible within said predetermined amount of time;

vi) awarding each of said one players a predetermined number of points for each of said bonus-challenge cards solved as compared with said solution on said bonus-challenge card back surface in accordance with steps 9iii)–9v); and vii) adding the total of said predetermined number of points to the score of said first playing player/team whose said one player chosen in accordance with step 9i) received the most points in accordance with step 9vi).

* * * * *